United States Patent [19]

Tamura et al.

[11] Patent Number: 4,541,572

[45] Date of Patent: Sep. 17, 1985

[54] PULVERIZING, DRYING AND TRANSPORTING SYSTEM FOR INJECTING A PULVERIZED FUEL INTO A BLAST FURNACE

[75] Inventors: Setsuo Tamura; Kenjiro Motonaga, both of Nishinomiya; Takumi Mizokawa, Kobe; Kozo Tanaka, Miki; Katsumi Kawashima, Kobe; Takaaki Hiwatashi, Kakogawa; Takayuki Sugahara, Akashi, all of Japan

[73] Assignee: Kabushiki Kaisha Kobe Seiko Sho, Kobe, Japan

[21] Appl. No.: 514,886

[22] Filed: Jul. 18, 1983

[30] Foreign Application Priority Data

Aug. 10, 1982 [JP] Japan ..... 57-139627

[51] Int. Cl.[4] ..... B02C 21/00

[52] U.S. Cl. ..... 241/31; 241/33; 241/48; 241/57; 241/65; 241/79.1

[58] Field of Search ..... 241/62, 57, 48, 65, 241/23, 17, 1, 79.1, 33, 31, 19; 110/347; 432/106, 78

[56] References Cited

U.S. PATENT DOCUMENTS 1,455,392 5/1923 Diepschlag .
2,410,337 10/1946 Cooper et al. .
3,078,048 2/1963 Russell et al. .
3,602,164 8/1971 Reintjes .
3,610,594 10/1971 Williams .
4,193,554 3/1980 Ansen et al. .
4,226,371 10/1980 Williams .
4,280,418 7/1981 Erhard .

*Primary Examiner*—Mark Rosenbaum
*Attorney, Agent, or Firm*—Oblon, Fisher, Spivak, McClelland & Maier

[57] ABSTRACT

Disclosed is a pulverizing, drying and transporting system for a pulverized fuel of a blast furnace of the type having at least one hot stove for supplying hot blast air, said hot stove also providing hot stove exhaust gas. The system includes a pulverizing and drying unit for pulverizing lamp raw fuel and drying the pulverized fuel. The hot stove gas is supplied to the pulverizing and drying unit. The hot stove exhaust gas dries the pulverized fuel and conveys it to a pulverized fuel collecting and separating device which separates the gas from the pulverized fuel. The line supplying the hot stove gas to the pulverizing and drying unit includes a heating device for selectively supplying additional heat to the hot stove exhaust gas. Moreover, the line for supplying the hot stove gas to the pulverizing and drying unit can include at least one of a temperature stabilizing device and a cooling device. The heating and cooling devices and controlled by a controller sensitive to the gas temperature at the outlet of the pulverizing and drying unit for maintaining the gas temperature at the outlet of the pulverizing and drying unit at a constant level. The temperature stabilizing device maintains the gas temperature at the outlet of the temperature stabilizing device at a designated level.

7 Claims, 8 Drawing Figures

PULVERIZING, DRYING AND TRANSPORTING SYSTEM FOR INJECTING A PULVERIZED FUEL INTO A BLAST FURNACE

BACKGROUND OF THE INVENTION

1. Field of the Invention

The present invention relates to an improvement in a pulverizing, drying and transporting system for a lump raw material (hereinafter referred to simply as the "raw material") to be injected as a pulverized fuel into a blast furnace, and more particularly to a system which is superior in fuel economy and safety of operation.

2. Description of the Prior Art

As an auxiliary fuel for injection in a blast furnace operation, heavy oil has heretofore been mainly used, but due to a recent steep rise in heavy oil prices, the use of heavy oil has been discontinued in most blast furnaces for reasons of economy, and an all coke operation now predominates. In the case of all coke operation, however, the stability of the blast furnace operation is apt to be imparied by the lack of furnace heat control methods, the occurrence of trouble (e.g. increase of slip) in operation, etc. As a substitute for heavy oil, therefore, the use of a pulverized fuel (e.g. pulverized coal and coke) as an auxiliary fuel has been considered very effective from the standpoint of economy and flexibility of operation, and such pulverized fuels are now in practical use in some blast furnaces. For supply of a pulverized fuel up to the tuyere of a blast furnace, according to conventional equipment, the raw material, after pulverizing and drying, is conveyed with a gas to a pulverized fuel collecting and separating device, where the pulverized fuel is separated from the gas and temporarily stored in a predetermined place. The pulverized fuel may later be further conveyed with a gas up to the tuyere of the blast furnace.

In this connection, reference is here made to FIG. 1 which is a schematic illustration of a conventional pulverizing, drying and transporting system, wherein the reference numeral 1 denotes a raw material feed unit from which the raw material is fed to a pulverizing and drying unit 2, where it is pulverized to a desired particle size (e.g. 80% particles are of 200 mesh or smaller). To the pulverizing and drying unit 2 are connected lines 4 and 5 for conveying a high-temperature gas which is introduced and conveyed by a blower 3 controlled by the gas temperature. A heating furnace 6 is disposed in the line 4.

On the other hand, in the line 5 is disposed a pulverized fuel collecting and separating unit 7, at the upstream side of the blower 3. A fuel A such as heavy oil or city gas and combustion air B are fed respectively through lines $L_1$ and $L_2$ into the heating furnace 6, where they are mixed and burned to produce an exhaust flue gas at a high temperature (1,000°~1,300° C.). The reference C designates air, which is fed through line $L_3$ into the heating furnace 6, where it is mixed with the above exhaust flue gas and then fed to the pulverizing and drying unit 2. The mixed gas thus fed to the pulverizing and drying unit 2 dries the raw material being pulverized to a moisture content of about 1% while passing through the unit 2 and then conveys the pulverized material to the collecting and separating unit 7. The pulverized fuel separated and collected by the unit 7 is fed to a coal-bin 11 and stored therein, while the mixed gas is discharged outside the system by means of the blower 3. The pulverized fuel thus fed and stored in the coal-bin 11 may be subsequently fed to a tuyere 14 of a blast furnace 13 through, for example, a distributing unit 12.

In such a system, however, since a high-temperature gas is used for drying and conveying the pulverized fuel, it is necessary to use a large quantity of exhaust flue gas obtained by burning fuel, such as heavy oil, in the heating furnace 6. Therefore the volume of fuel consumption becomes large and the running cost greatly increases. Besides, since the exhaust flue gas is diluted and cooled with air before use, because its temperature reaches as high as 1,000° C. or more, the oxygen concentration in the mixed gas is increased to the extent that there may occur an explosion of coal dust. To avoid such a coal dust explosion, it becomes necessary to incorporate in the above system a device capable of detecting an initial state of such explosion, on the basis of a sudden rise of pressure or of a carbon monoxide concentration, and injecting a fire-extinguishing agent into the system. But this results in a more complicated construction of the system and the increase of both equipment cost and maintenance cost. Since the above-mentioned system does not prevent the occurrence of such a coal dust explosion it lacks reliability in ensuring safety of operation.

In such a conventional system, therefore, it has been required to take remedial measures from the following three points of view: (1) reduction of fuel consumption, (2) simplification of equipment and maintenance and (3) ensuring safety from coal dust explosion.

SUMMARY OF THE INVENTION

According to the present invention, all of those requirements can be met by utilizing the characteristics of an exhaust gas from a hot stove for the blast furnace (hereinafter referred to simply as the "hot stove exhaust gas"), and at the same time by adopting a simple control method capable of maximizing the efficiency of the use of the retained heat in the hot stove exhaust gas. As a device for feeding a high-temperature hot air to a blast furnace, there has been used hot stoves, three or four of which are usually provided for one blast furnace. These hot stoves are constructed to continuously feed constant high-temperature hot air to the corresponding blast furnace by alternating heat accumulation and heat exchange to a hot air supply. In the heat-accumulating operation of the hot stove there is provided an inert hot stove exhaust gas at a relatively high temperature (about 200°~350° C.), but heretofore this exhaust gas has been used only for preheating the combustion air and fuel for the hot stove. Moreover, even when the hot stove exhaust gas is used for preheating such fuel and air, the gas is discharged to the atmosphere after use although it possesses a sensible heat above 100° C. Taking note of the characteristics of this hot stove exhaust gas, (i.e., its temperature is relatively high and its oxygen concentration is low, about 1%) and paying special attention to the fact that this exhaust gas is always obtainable during operation of a blast furnace, the present invention uses this hot stove exhaust gas as a drying and transporting medium for a pulverized fuel and adopts means capable of appropriately controlling the temperature of the hot stove exhaust gas.

According to the present invention, a high-temperature gas line at the upstream side of a pulverizing and drying unit includes an hot stove exhaust gas introducing line. A heating unit is disposed in said line and in the vicinity of the pulverizing and drying unit. Either a temperature stablizing unit and a cooling unit are disposed in any desired order in the line or only a temperature stablizing unit is disposed in the line at an upstream side of the heating unit. In operation of the system, in order that the gas temperature at the outlet of the pulverizing and drying unit may be constant, that is, in order to assure that the moisture contained in the raw material is dried off, the temperature of the hot stove exhaust gas fed to the pulverizing and drying unit is controlled appropriately by (1) the combination of the following three means: a heating means, a temperature stabilizing means and a cooling means, or (2) the combination of the following two means: a heating means and a temperature stabilizing means.

Thus the present invention effectively utilizes the retained heat and inertness of the hot stove exhaust gas. Therefore it is possible to save fuel consumption in the heating furnace and to prevent the occurrence of a coal dust explosion within the system.

BRIEF DESCRIPTION OF THE DRAWINGS

Various other objects, features and attendant advantages of the present invention will be more fully appreciated as the same becomes better understood from the following detailed description when considered in connection with the acccompanying drawings in which like reference characters designate like or corresponding parts throughout the several views and wherein.

DETAILED DESCRIPTION OF THE PREFERRED EMBODIMENTS

Figure 1:
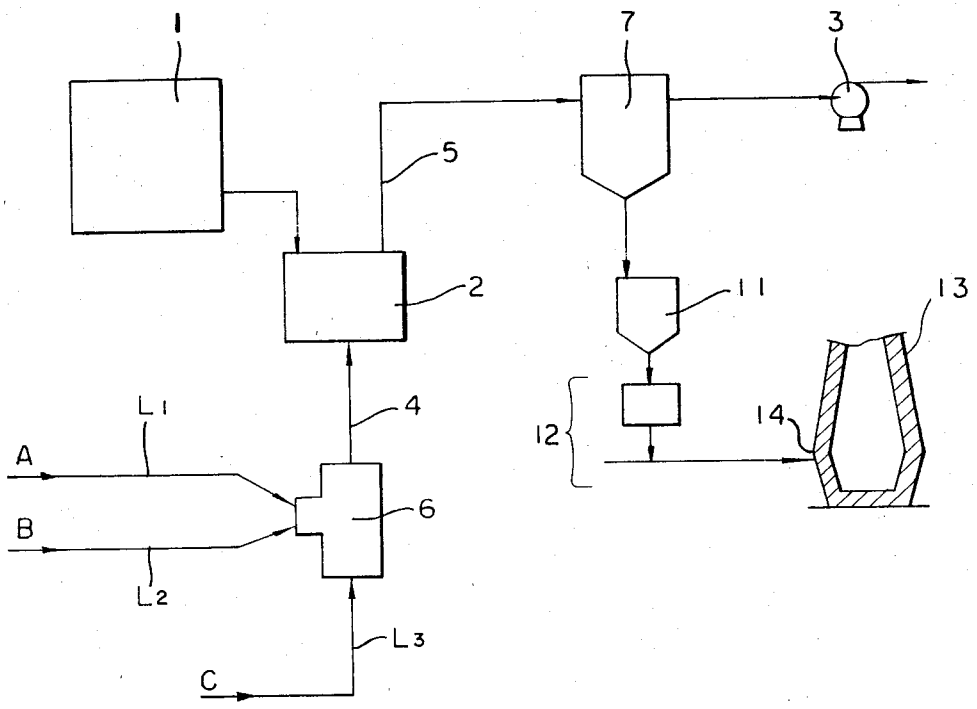
FIGURE 1 PRIOR ART
FIG. 1 is a schematic illustration of a conventional system.
Figure 2:
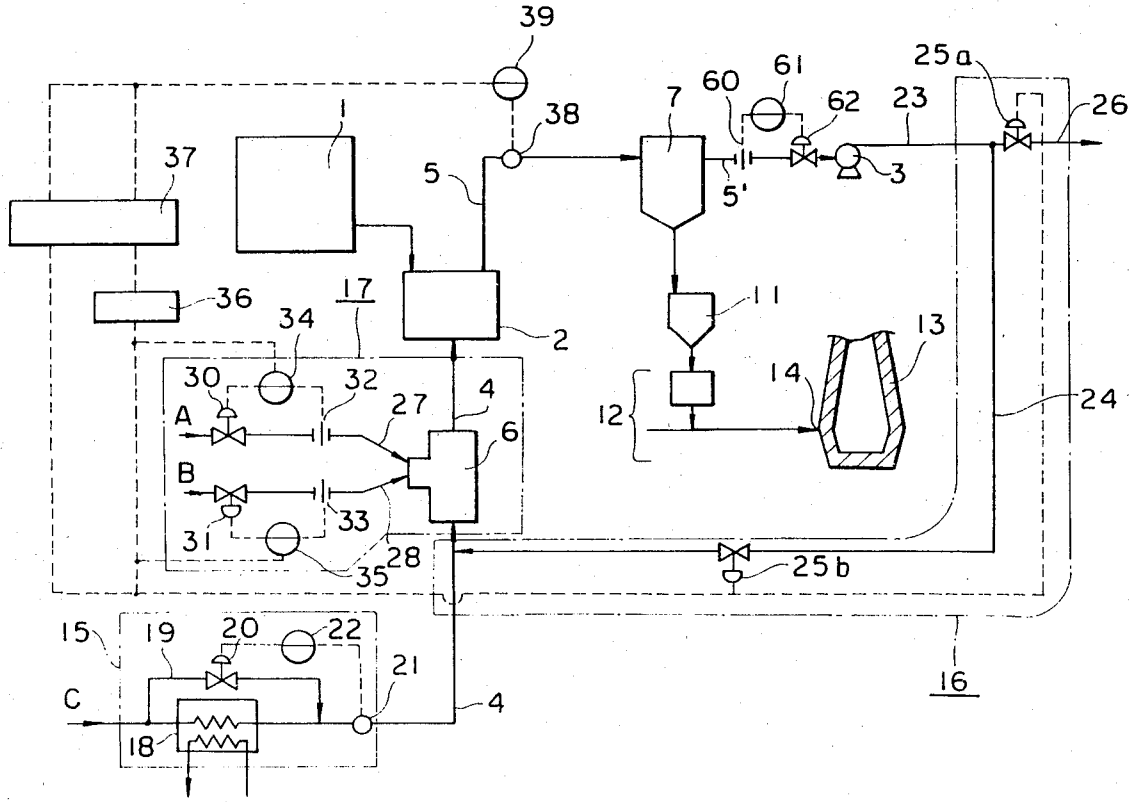
FIG. 2 is a schematic illustration of one embodiment of the present invention.

FIG. 2 is a schematic illustration of a pulverizing, drying and transporting system for injecting a pulverized fuel into a blast furnace, according to the present invention. Reference numeral 1 designates a raw material feed unit and numeral 2 designates a pulverizing and drying unit for pulverizing the raw material fed from the unit 1 to a desired particle size (e.g. 80% particles are of 200 mesh or smaller), and drying the pulverized fuel. The pulverizing and drying unit may be separated into a pulverizing unit and a drying unit, respectively. To the pulverizing and drying unit 2 are connected by lines 4 and 5 for a high-temperature gas which is introduced by a blower 3 and which is kept under temperature control (split control system) as will be described later. Line 4 serves as a path for introducing the hot stove exhaust gas C, and the line 5 serves as a path for transporting a pulverized fuel and gas mixture. Moreover, a collector-separator 7 is disposed in the line 5 at the upstream side of the blower 3. In line 5, between the collector-separator 7 and the blower 3, is disposed a flow rate control section composed of a flow rate detecting sensor 60, a flow rate indication controller 61 and a control valve 62 controlled by the controller 61. This flow rate control section functions to adjust, by adjusting the valve 62, the flow rate of the high-temperature gas passing through the outlet of pulverizing and drying unit 2. This allows the classifying function within the unit 2 to be carried out stably, and at the same time functions to maintain the transportation speed of the pulverized fuel at above a certain value to prevent the pulverized fuel from being accumulated within the line 5. The construction of coal-bin 11, distributing unit 12, blast furnace 13 and tuyere 14 is the same as that shown in FIG. 1.

Furthermore, in the line 4 are respectively disposed, in the flow direction of the hot stove exhaust gas, a temperature stabilizing unit 15, a cooling unit 16 and a heating unit 17.

Figure 8:
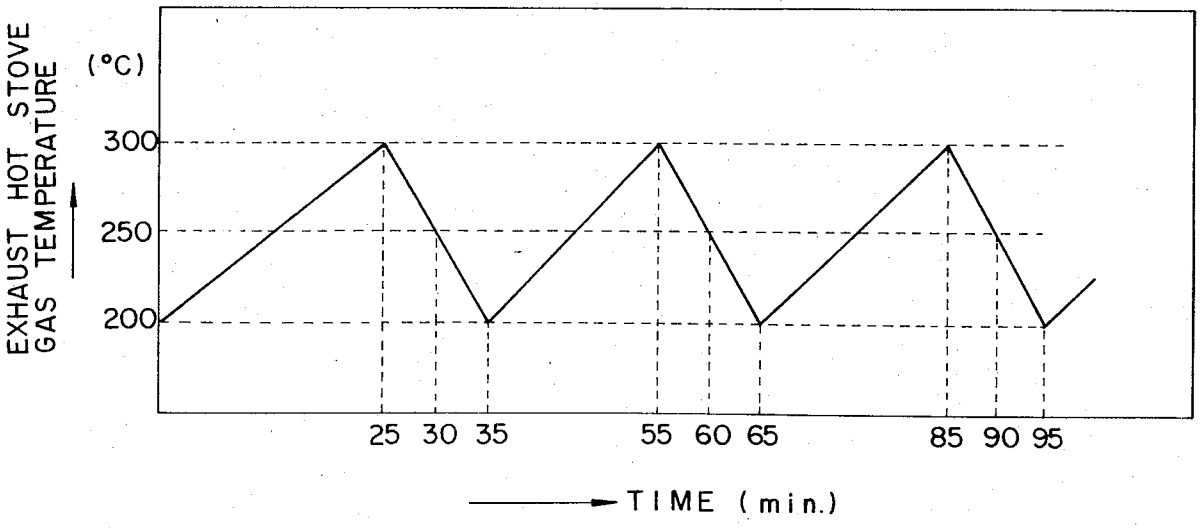
FIG. 8 is a graph illustrating temperature variation characteristics of the hot stove exhaust gas.

The temperature stabilizing unit 15 is provided with a view to levelling periodic changes in temperature of the hot stove exhaust gas to a substantially constant temperature. In this connection, reference is here made to FIG. 8 which illustrates changes over time in the temperature of the hot stove exhaust gas just downstream of the outlet of the hot stoves in a continuous operation using four hot stoves while alternately switching between two stove-combustion and two stove-hot air supply as hot air is supplied to the blast furnace. From this figure it is seen that the temperature of the hot stovè exhaust gas changes at every switching and this temperature variation continues in a periodic manner. But such a temperature variation is not desirable because it acts to disturb the control operation when performing temperature control for the cooling unit 16 and the heating unit 17, as will be described later. After the temperature of the hot stove exhaust gas has been leveled to a substantially constant temperature by the temperature stabilizing unit 15, the gas is fed to the pulverizing and drying unit 2.

The unit 15 is shown in FIG. 2 and includes a heat exchanger 18 disposed in line 4. Hot stove combustion air is introduced into the heat exchanger 18 to partially recover heat by heat exchange with the hot stove exhaust gas. The inlet and outlet of the heat exchanger 18 are selectively connected directly with each other by means of a by-pass line 19 to control the by-passing amount of the hot stove exhaust gas whereby the temperature of said hot stove gas at the outlet of the heat exchanger 18 can be made substantially constant. The reference numeral 20 designates a control valve, numeral 21 a temperature detecting sensor and numeral 22 a temperature indication controller for controlling the valve 20 so as to maintain a constant temperature in line 4.

In the cooling unit 16, a discharge line 23 from the blower 3 and the line 4 are interconnected by a by-pass line 24. A control valve **25*a* is disposed in the upstream end of line 26 connected to the discharge line 23 downstream of the junction with the by-pass line 24. Further, an on-off valve 25*b* is mounted in the by-pass line 24. By operating the valves 25*a* and 25*b*, part of the exhaust gas in discharge line 23 and having a relatively low temperature is by-passed to the line through the by-pass line 24 to mix with the hot stove exhaust gas therein and to thereby lower the temperature of the hot stove exhaust gas in the line 4. Operation of the control valve 25*a* and the on-off valve 25*b* is performed on the basis of commands provided from a control unit 37** as will be described later.

In the heating unit 17, a heating furnace 6 is mounted in the line 4, and to the heating furnace 6 are connected a line 27 for supplying fuel A such as city gas and a line 28 for supplying air B for combustion of fuel A. To the lines 27 and 28 are connected control valves 30, 31 controlled by flow rate detecting sensors 32, 33 through flow rate indication controllers 34, 35, respectively. Furthermore, the flow rate indication controllers 34 and 35 are connected to the control unit 37 through an air/fuel ratio control circuit 36.

A temperature detecting sensor 38 for measuring the temperature of gas in the line 5 is mounted in line 5 at a position close to the pulverizing and drying unit 2, the detecting sensor 38 being connected to the control unit 37 through a temperature indication controller 39. The control unit 37 incorporates a so-called split control circuit, which fulfills a control function by issuing commands for switching the cooling unit 16 and the heating unit 17, by simultaneously adjusting the valves 25*a* and 25*b* in the cooling unit 16, and the valves 30 and 31 in the heating unit 17, respectively, according to the outlet temperature of the pulverizing and drying unit 2 in order to make the detected temperature at the detecting sensor 38 almost constant. This assures that the moisture contained in the raw material is completely dried.

That is, it is necessary that the temperature of the hot stove exhaust gas fed from the line 4 to the pulverizing and drying unit 2 be changed according to the moisture content of the raw material and the amount of the raw material fed to the pulverizing and drying unit 2. For example, when the water content of the raw material or the amount thereof which is fed increases, the retained heat of the hot stove exhaust gas may be insufficient to dry off the moisture. That such a state is reached is detected by a reduced temperature detected at the temperature detecting sensor 38. The sensed temperature drop is transmitted from the temperature indication controller 39 to the control unit 37. Thereafter a high-temperature flue gas increase command is provided from the control unit 37 to the heating unit 17 through the air/fuel ratio control circuit 36. More specifically, the opening of the control valves 30 and 31 is adjusted according to newly set amounts of fuel and air. Thus, the hot stove exhaust gas is mixed with the flue gas combustion products in the heating furnace 6 and, after so increasing the retained heat, the mixed gas is fed to the pulverizing and drying unit 2. Therefore, sufficient drying becomes attainable. Moreover, since the heating furnace 6 is operated under air/fuel control by unit 36 so that the gas A is always in a state of complete combustion, the exhaust flue gas is inert, so even if it is mixed with the hot stove exhaust gas, the inertness of the entire mixed gas is never lost.

In this state where the heating unit 17 is functioning, that is, in a state where the control valves 30 and 31 are largely open, allowing large quantities of fuel and air to enter the heating furnace 6 and burn, if a rise in temperature is detected at the temperature detecting sensor 38 caused by a decrease of the moisture content of the raw material or by decrease of the quantity of the raw material fed, a signal to decrease the temperature is transmitted from the temperature indication controller 39 to the control unit 37 and a production decrease command for the high-temperature exhaust flue gas is provided from the control unit 37 to the heating unit 17 through the air/fuel ratio control circuit 36. In this case, the opening of the control valves 30 and 31 becomes smaller and the quantity of the high-temperature exhaust gas burned within the heating furnace 6 decreases so that the temperature at the temperature detecting sensor 38 returns to a predetermined level (about 80° C.).

Conversely, when the moisture content of the raw material or the amount of raw material fed decreases to a degree where the retained heat of the hot stove exhaust gas becomes larger than necessary for drying of the moisture, even with furnace 6 operating at minimum capacity, this leads to a waste of heat energy. Such a condition is detected as an increase in temperature at the temperature detecting sensor 38 which causes a signal to be transmitted from the temperature indication controller 39 to the control unit 37. Then a by-pass exhaust gas quantity increase command is issued by the control unit 37. More specifically, the opening of the control valve 25*a* is made smaller, and the on-off valve 25*b* is fully opened thereby allowing the exhaust gas having relatively low temperature in the discharge line 23 to be by-passed in a larger quantity through line 24 to the line 4 so as to decrease the retained heat of the hot stove exhaust gas in the line 4. Also in this case, since the by-passed exhaust gas is inert, the entire mixed gas remains inert even if the hot stove exhaust gas is mixed with the by-passed exhaust gas.

Thus, in the present invention, the system for pulverizing, drying and transporting the raw material fully utilizes the retained heat and inertness of the hot stove exhaust gas, and therefore the quantity of fuel consumption in the heating furnace is largely decreased and it is possible to reduce the running cost. It is also possible to prevent the occurrence of coal dust explosion in the pulverizing, drying and transporting system and so it becomes unnecessary to install the conventional expensive and complicated anti-explosion device.

As set forth hereinabove, in order to effect a satisfactory drying of the raw material, it is necessary that the temperature of the high-temperature gas fed from the line 4 to the pulverizing and drying unit 2 be changed according to the moisture content and quantity of the raw material fed to the pulverizing and drying unit 2. In this connection, there were experimentally obtained the results shown in Table 1. In Table 1, the horizontal and vertical columns represent moisture content Mc (%) and feed rate F (dry-kg/hr), respectively, of the raw material, and the crossing of columns of Mc and F represents the temperature (°C.) at the high-temperature gas inlet side of the pulverizing and drying unit 2. Drying was performed under such conditions as to give a gas temperature of 80° C. at the outlet of the pulverizing and drying unit 2 and a 1% moisture content of the pulverized fuel.

TABLE 1

| F | Mc (%) | | |
|---|---|---|---|
| (dry-kg/hr) | 15 | 10 | 7 |
| 13,000 | 315° C. | 227° C. | 183° C. |
| 10,000 | 257 | 193 | 160 |
| 8,000 | 220 | 170 | 144 |
| 6,000 | 184 | 149 | 130 |
| 4,330 | 156 | 131 | 117 |

Moreover, the foregoing effect of reduction in fuel consumption has been confirmed experimentally (under the same drying conditions as in the above experiment), as follows. The consumption of coke oven gas was compared with respect to the case where the hot stove exhaust gas was used in operating the system of the present invention versus the case where it was used in the operation of the conventional system. As a result, it was confirmed that as much as 80% of the coke oven gas could be saved in the former case as compared with the latter.

Figure 3:
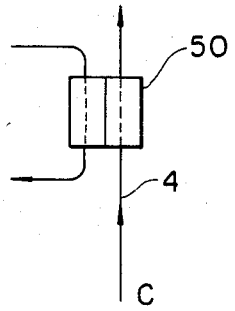
FIG. 3 illustrates a modification of a heating unit according to the present invention.

In the above embodiment, the heating furnace 6 was used in the heating unit 17. But, for example, as shown in FIG. 3, the hot stove exhaust gas may be heated in a heat exchanger 50 by other heating media, without using the heating furnace 6 and mixing the flue gas therewith.

Figure 4:
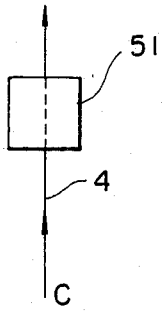
FIG. 4 illustrates a modification of a cooling unit according to the present invention.

As to the cooling unit 16, instead of adopting the above-exemplified by-passing system, the hot stove exhaust gas may be cooled directly or indirectly in such a heat exchanger 51 as shown in FIG. 4, or in a fan cooler.

Figure 5:
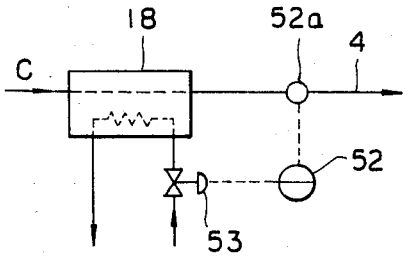
FIGS. 5 and 6 illustrate modifications of temperature stabilizing units according to the present invention.
Figure 6:
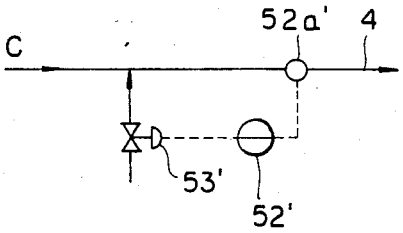

As to the temperature stabilizing unit 15, moreover, the one shown in the above embodiment was of a by-pass type, but, for example, as shown in FIG. 5, a cooling or heating medium may be directly introduced into the heat exchanger 18 without by-pass, and the opening of a control valve 53 may be adjusted by a temperature indication controller 52 having a sensor 52*a* to control the flow rate of the cooling or heating medium so that the temperature of the hot stove exhaust gas in line 4 at the outlet portion of the heat exchanger 18 becomes almost constant. Furthermore, as shown in FIG. 6, the hot stove exhaust gas may be mixed directly with a heating or cooling medium having an inert composition which does not impair the inertness of the exhaust gas. The control valve 53', temperature indication controller 52' and sensor 52*a'* can be used to adjust the flow rate of the heating or cooling medium so that the gas temperature at the downstream side of sensor 52*a'* becomes almost constant.

Figure 7:
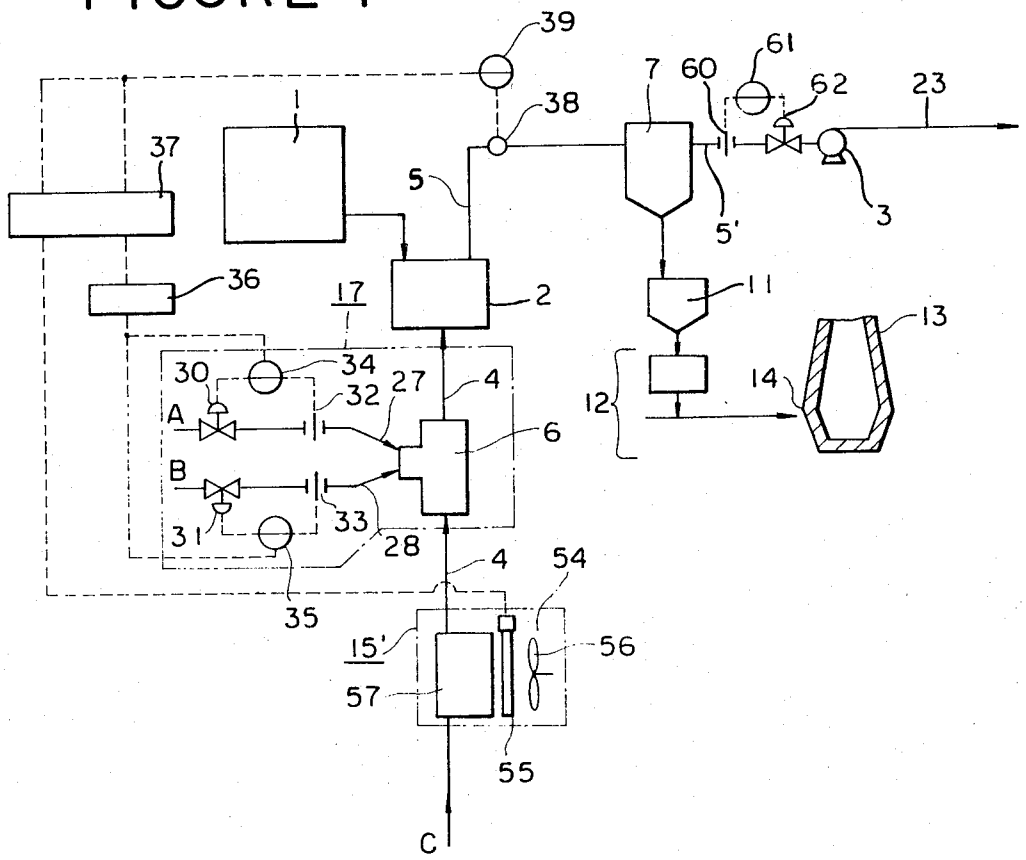
FIG. 7 is a schematic illustration of another embodiment of the present invention.

In the above embodiment, moreover, the temperature stabilizing unit 15 and the cooling unit 16 were independent, but in the case of using a temperature stabilizing unit which has both a temperature stabilizing function and a cooling function, it is not necessary to provide the cooling unit 16. For example, as shown in FIG. 7, an air fin type heat exchanger 54 capable of adjusting the air quantity is disposed in the line 4 as a temperature stabilizing unit 15'. Here, the air quantity adjustment is performed by adjustment of the openings of vanes 55 disposed between fan 56 and heat exchanger coils 57. The vanes 55 are controlled by the control unit 37. It is thus possible to exclude from the line 4 both a temperature stabilizing unit 15 of a by-pass type and a cooling unit 16 of the same type as used in the embodiment of FIG. 2. Therefore the process is simplified and a reduction of equipment cost is also attainable.

The pulverizing, drying and transporting system for the raw material according to the present invention is constructed as hereinabove described. This system effectively utilizes the retained heat of the hot stove exhaust gas to pulverize, dry and transport the raw material. As a result, the fuel consumption as compared to the conventional heating furnace can be reduced and a possible explosion of coal dust in the system can be completely prevented.

Thus the fuel economy and safety of operation in this system can be greatly improved.

Obviously, numerous modifications and variations of the present invention are possible in light of the above teachings. It is therefore to be understood that within the scope of the appended claims, the invention may be practiced otherwise than as specifically described herein, for example, in the fields of fluidized bed combustion furnace for use in electric power generation and other industrial coal firing furnace and kiln.

What is claimed as new and desired to be secured by Letters Patent is:

1. A pulverizing, drying and transporting system for a pulverized fuel of a blast furnace having at least one hot stove for supplying hot blast air, said hot stove also producing a hot stove exhaust gas, said system comprising:

a pulverizing and drying unit for pulverizing lump raw fuel and drying the pulverized fuel;

first conduit means connected between at least one stove and an inlet end of said pulverizing and drying unit for supplying hot stove exhaust gas to said pulverizing and drying unit so as to dry said pulverized fuel;

heating means positioned in said first conduit means for supplying additional heat to said hot stove exhaust gas;

at least one of a temperature stabilizing means and a cooling means positioned in said first conduit means at a point upstream from said heating means;

a pulverized fuel collecting and separating means for separating said pulverized fuel from said hot stove exhaust gas;

second conduit means connected between an outlet end of said pulverizing and drying unit and said collecting and separating means; and a first temperature sensor in said second conduit means and first controller means constructed so as to receive a signal from said first temperature sensor and to control said heating means and said cooling means as a function of said sensed temperature.

2. The system of claim 1 wherein said heating means comprise:

a heating furnace disposed in said first conduit means;

fuel gas supply means connected to said heating furnace;

combustion air supply means connected to said heating furnace, whereby said fuel gas is consumed and mixed with said hot stove exhaust gas to produce additional heat for said hot stove exhaust gas.

3. The system of claim 2 including:

first fluid flow rate control means in each of said fuel gas supply means and said combustion air supply means; and a fuel/air ratio control circuit, wherein said first controller means is connected to said first flow rate control means via said fuel/air ratio control circuit for controlling said heating means.

4. The system of claim 1 wherein said temperature stabilizing means comprise:

a heat exchanger in said first conduit means at a point upstream from said heating means; and a first by-pass means in said first conduit means for by-passing said heat exchanger.

5. The system of claim 4 including a second temperature sensor in said first conduit means and second controller means constructed so as to receive a signal from said second temperature sensor and to control said first by-pass means as a function of said sensed temperature.

6. The system of claim 1 wherein said system includes third conduit means for conveying separated gas from said separating means, and wherein said cooling means comprise:

fourth conduit means connected between said third conduit means and said first conduit means at a point upstream from said heating means;

a first valve in said third conduit means at a point downstream of said fourth conduit means, and a second valve in said fourth conduit means, whereby cool gas in said third conduit means can be selectively by-passed to said first conduit means.

7. The system of claim 6 wherein said first controller means is connected to said first and second valves for controlling the by-pass of said cool gas.

* * * * *